US007053340B2

(12) United States Patent
Wilde et al.

(10) Patent No.: US 7,053,340 B2
(45) Date of Patent: May 30, 2006

(54) HEATING DEVICE WITH TWO AREAS

(75) Inventors: Eugen Wilde, Knittlingen (DE); Hans Mohr, Sulzfeld (DE)

(73) Assignee: E.G.O. Elektro-Geraetebau GmbH (DE)

( * ) Notice: Subject to any disclaimer, the term of this patent is extended or adjusted under 35 U.S.C. 154(b) by 0 days.

(21) Appl. No.: 10/767,655

(22) Filed: Jan. 29, 2004

(65) Prior Publication Data

US 2004/0182850 A1 Sep. 23, 2004

(30) Foreign Application Priority Data

Feb. 17, 2003 (DE) ..... 103 07 246

(51) Int. Cl.
*H05B 3/68* (2006.01)

(52) U.S. Cl. ..... 219/446.1; 219/402.1

(58) Field of Classification Search ..... 219/445.1, 219/446.1, 448.11, 448.12, 448.19, 460.1, 219/461.1, 462.1, 483, 485, 510, 511, 512
See application file for complete search history.

(56) References Cited

U.S. PATENT DOCUMENTS 4,327,280 A 4/1982 McWilliams
4,350,875 A * 9/1982 McWilliams ..... 219/448.19
4,430,558 A 2/1984 McWilliams
5,171,973 A * 12/1992 Higgins ..... 219/457.1
5,270,519 A 12/1993 Higgins
5,498,853 A 3/1996 Gross et al.
6,018,149 A * 1/2000 Higgins ..... 219/462.1

FOREIGN PATENT DOCUMENTS

| | | | |
|---|---|---|---|
| DE | 32 06 024 | A1 | 9/1983 |
| DE | 33 145 01 | A1 | 10/1984 |
| DE | 34 23 086 | A1 | 1/1985 |
| DE | 33 33 645 | A1 | 4/1985 |
| DE | 198 14 949 | A1 | 11/1998 |
| EP | 0 471 171 | A2 | 2/1992 |
| EP | 0 590 315 | A2 | 4/1994 |
| GB | 2 324 946 | A | 11/1998 |

* cited by examiner

*Primary Examiner*—Sang Paik
(74) *Attorney, Agent, or Firm*—Akerman Senterfitt

(57) ABSTRACT

A radiant heater is provided, which is subdivided into three concentric areas and which can be mounted under a glass ceramic cooking area. It has a rod controller and the two innermost heating areas are jointly protected against excess temperatures by means of the rod controller. The outermost heating area has a low surface power of 2.5 W/cm$^2$, for example, and consequently does not have to be monitored by the rod regulator with regards to the danger of an excess temperature for a glass ceramic cooking area.

12 Claims, 2 Drawing Sheets

HEATING DEVICE WITH TWO AREAS

FIELD OF APPLICATION AND PRIOR ART

The invention relates to a heating device. Such a heating device is particularly suitable for a cooking point with a glass ceramic cooking area.

The heating up, preboiling or precooking time for radiant heaters as heating devices is on the one hand dependent on the set glass ceramic surface temperature and the quality of the cooking utensil used and on the other on the rated output of the radiant heater and therefore its power density. In many cases it is desirable to shorten said precooking time in order to achieve comfortable operation and rapid cooking. However, it is not possible to increase to infinity the power density of a radiant heater. In the case of radiant heaters with strip heating conductors, as from a certain power density the heating conductor temperature no longer can be held within the predetermined upper limits.

Values for power densities with such radiant heaters are given, which represent a good compromise between the precooking time, the quality of the cooking utensil used and the heating conductor temperature. An advantageous power density can be 8 Watt/cm$^2$. For radiant heaters with a nominal diameter of 140 and 180 mm, such a power density is successfully used.

However, there are also certain limits to this power density. As from a nominal heater diameter of 210 mm with theoretically 2700 Watt power, the switching capacity of the electromechanical rod controller or protective thermal cutout, which represent the protection against overheating for the glass ceramic cooking area, is exceeded. The switching capacity of the protective thermal cutout is at a certain current intensity resulting from the predetermined mains voltage, for example of 110 or 230 Volt, and a specific power value.

An object of the invention is to provide a heating device of the aforementioned type, which makes it possible to avoid the problems of the prior art and in particular to make the size of the radiant heater more variable independently of the power density or a switching capacity of protective thermal cutouts.

This problem is solved by a heating device having the features of claim 1, as well as the features of claim 14. Advantageous and preferred developments of the invention form the subject matter of the further claims and are illustrated hereinafter. By express reference the wording of the claims is made into part of the content of the present description.

According to the invention a heating device is subdivided into at least one first and one second area. A first area can be monitored by a first excess temperature protection. The latter can for example be a rod controller or a protective thermal cutout, which at least partly engages or passes over said first area.

The first area has a maximum first power level, which is matched to the aforementioned values. A second heating device area is operated without monitoring by the first excess temperature protection. In particular, the second area is operated without an excess temperature protection. This is achieved in that the maximum power per unit surface of the second area is approximately 2.5 Watt/cm$^2$. Here it is possible to operate a radiant heater under a glass ceramic cooking area without a rod controller or protective thermal cutout. Within the scope of the present invention, it has been found that there is no risk to standard glass ceramics with such a power value.

Thus, in a preferred embodiment of the invention the heating device is so-to-speak subdivided into two areas. A first area is operated with a critical power density and must consequently have a protective thermal cutout. This first area can be made sufficiently large that the protective thermal cutout is just able to handle or switch the power which occurs. In order to be able to enlarge the surface of the radiant heater over and beyond said maximum switchable power, use is made of a second area. This second area is always operated without monitoring by the excess temperature protection and preferably without any monitoring by an excess temperature protection. For this purpose a value is chosen for the power density, which is technically possible and admissible for glass ceramic material.

Alternatively a separate excess temperature protection could be provided for the second area. This would increase costs, but would improve safety.

The second area can engage on the first area and advantageously passes along half the outer border. This gives a somewhat elongated heating device. Advantageously the second area surrounds the first area and can be positioned concentrically. Whilst the lateral connection of a second area to a first area roughly corresponds to a known, elongated heating means for a frier, a concentric arrangement is advantageous for use of either small or large, round cooking utensils.

In order to additionally raise the precooking power, the power for the first area can be more than the standard basic power for a radiant heater of this size. In particular, the power here can extend up to the maximum value of the excess temperature protection, for example a rod controller. For example, the power for the first area can be max 2500 or 2700 Watt in the case of a round area with a diameter of 230 mm.

Moreover, advantageously the first area can have a switch-in power, which can be switched in to the basic power. The maximum first power then occurs when the switch-in power is also applied. Such a switch-in power can be a precooking surge or the like.

In particular as a result of the lower power density, the power for the second area can be somewhat lower, for example 600 Watt. As this power is advantageously present in the outer or marginal area in the form of the second area, where also saucepans with a not particularly flat bottom are placed, said power is always reduced. This avoids excessive heating of a glass ceramic cooking area. Moreover, in heating operation without a saucepan, for example when no heat output is removed, the glass ceramic in the marginal area has the greatest heat loss due to the larger surface. This also protects it against overheating.

According to a further development of the invention the heating device can have a control device and be connected thereto. This control device can have an additional contact for switching a basic power of the heating device or a switch-in power for the first area to the summated, total, maximum first power. Thus, the additional power can be defined and used as a precooking surge, for example.

The heating device can have an electronic control, with a contact switch arrangement for input purposes, for example. A further relay can be provided in order to switch the switch-in power to the total, maximum first power, in addition to the basic load.

The heating device is advantageously constituted by a radiant heater, which can have a heating conductor of resistance material. The heating conductor is preferably in so-called flat strip form and it is fitted upright on an insulating substrate and can be partly embedded therein.

These and further features can be gathered from the claims, description and drawings and the individual features, both singly or in the form of subcombinations, can be implemented in an embodiment of the invention and in other fields and can represent advantageous, independently protectable constructions for which protection is claimed here.

BRIEF DESCRIPTION OF THE DRAWINGS

An embodiment of the invention is described hereinafter relative to the attached drawings, wherein show.

DETAILED DESCRIPTION OF THE EMBODIMENT

Figure 1:
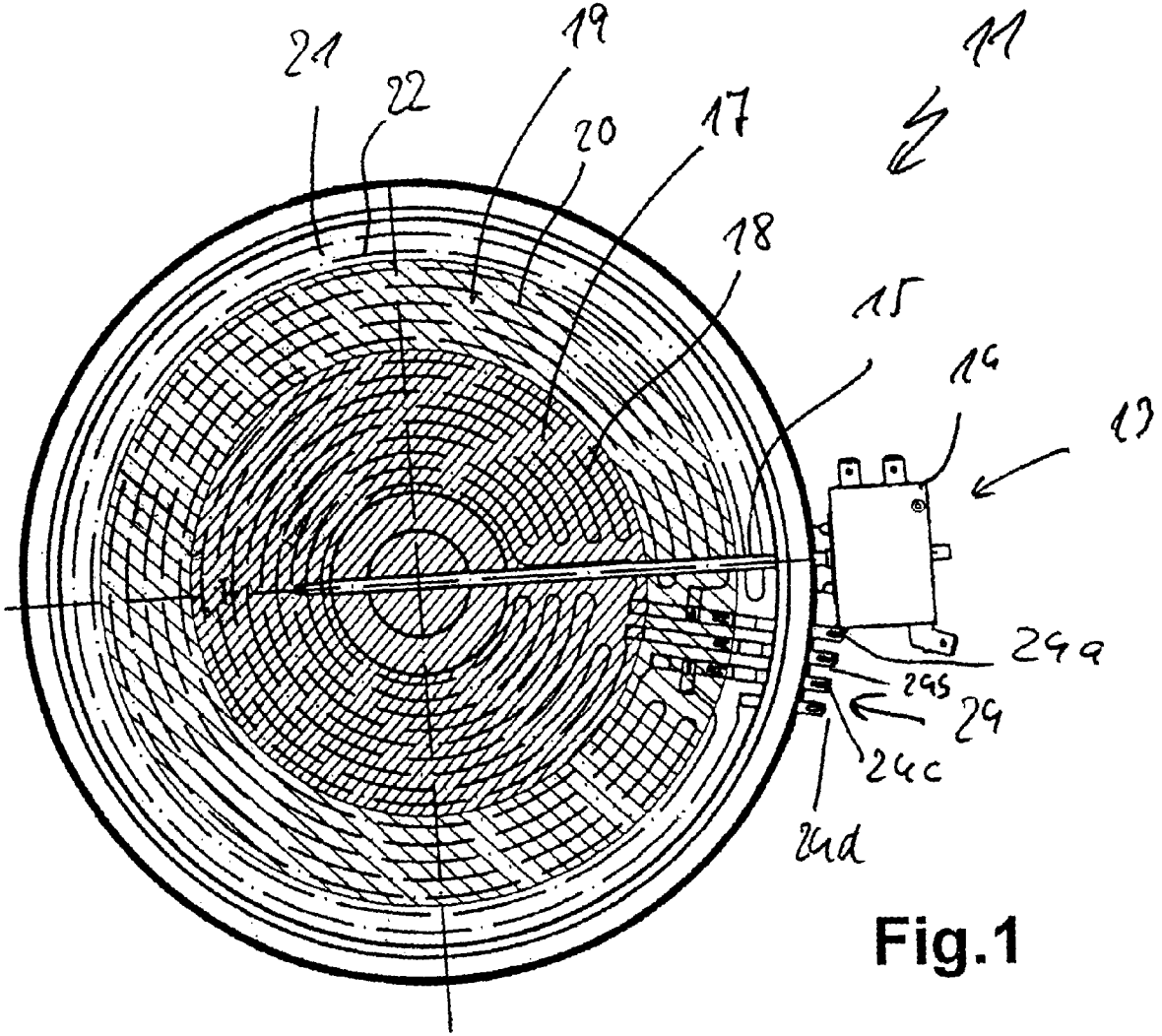
FIG. 1 A plan view of a radiant heater with a subdivision into three heating areas, as well as a rod controller.

FIG. 1 is a plan view of a radiant heater 11, as is known per se. A rod controller 13 passes over its heated area. The casing 14 of the thermal cutout or rod controller 13 is fixed to the side of the radiant heater 11. The sensor rod 15 projects radially somewhat beyond the centre of the radiant heater 11.

Said rod controller 13 brings about an excess temperature protection, in that it ensures that the temperature produced above the radiant heater 11 does not exceed a specific maximum temperature on the underside of a glass ceramic cooking area. This maximum permitted temperature is approximately 600° C. Such a rod controller and its operation can be gathered from DE 33 33 645 or DE 34 23 086.

The heating area of the radiant heater 11 is subdivided into a first, innermost area 17, which is surrounded by an annular, central, second area 19. The latter is in turn surrounded by a relatively narrow, circumferential, third area 21, which forms the outermost heating area.

The first area 17 is formed by first heating coils 18, which are laid in meander-like form. This basic structure of a radiant heater can be gathered from EP 590 315 and express reference is made thereto.

The heating area 19 is formed by second heating coils 20. The third area 21 is formed by third heating coils 22 which, as can be gathered from FIG. 1, comprise a single loop.

The heating coils 18, 20 and 22 are advantageously formed by a heating strip in upright flat strip form, for example. With regards to their characteristics, they can be specifically chosen in order to obtain a specific power distribution or operationally obtained surface power or total power. The heating coils 18 of the first area 17 have a smaller mutual spacing than the second heating coils 20 of the second area 19.

By means of several connecting lugs 24 the heating coils are connected to a power supply, power electronics or a so-called timing power regulator, for example. The heating coils 18 and 20 of the first and second areas are in each case contacted by means of the top connecting lug 24*a*, as can be readily seen. The connecting lug 24*a* is connected to the casing 14 of the rod controller 13. Thus, its electrical connection is monitored by the rod controller 13 and if an excess temperature occurs is interrupted in order to disconnect both the first heating area 17 and the second heating area 19. As can be gathered, by means of the rod controller 13 a distinction cannot be made between the first area 17 and the second area 19 in the case of an excess temperature. Thus, according to a further development of this embodiment, it would be possible to make such a distinction through a further rod controller. However, this is unimportant for the present invention in the scope dealt with here.

The third heating coil 22 of the outer, third area 21 is connected by means of the connecting lugs 24*c* and 24*d*. They are connected to a power supply without interposing the rod controller 13. Thus, they are clearly not monitored as regards excess temperature by the rod controller 13.

Operation

FIG. 1 makes it clear in the manner described hereinbefore that the heating coils of the first area 17 are more closely juxtaposed than in the two other areas and in area 19 they are more closely juxtaposed than in the third area 21. Thus, a certain progression exists and this leads to a progression of the surface power, because the more densely the heating coils of the same type are laid the higher said surface power.

Moreover and as referred to hereinbefore, by means of the special design of the individual heating conductors, their power and therefore once again the surface power can be influenced.

Figure 2:
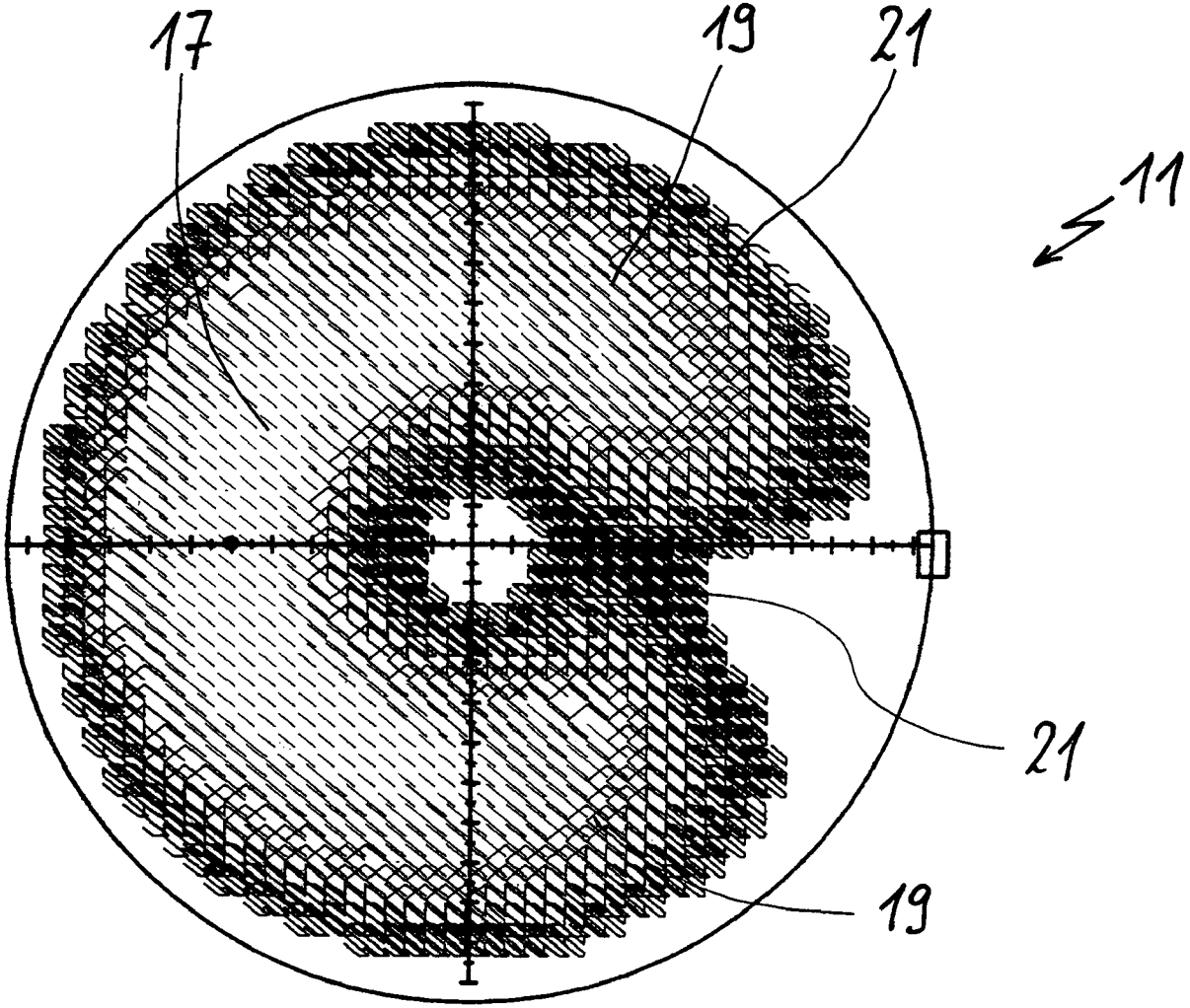
FIG. 2 A heat image of the radiant heater of FIG. 1 in operation.

FIG. 2 is a diagrammatic heat image of the radiant heater 11 of FIG. 1 when in operation. The different surface markings indicate the temperature prevailing in each case and the lighter they are the higher the temperature. The progression is 10° C. per brightness stage. The first area 17 is mainly the brightest and the temperature is here between 545 and 564° C. or at approximately 555° C. The second area 19 has temperatures in the range 524 to 544° C. The third area 21 mainly has temperatures in the range 494 to 514° C. or at approximately 500° C.

It must be borne in mind that in comparison with the claims the first area 17 and the second area 19 of the radiant heater 11 according to the embodiment of FIG. 1 correspond to the first area according to claim 1. The third area 21 of the radiant heater 11 corresponds to the second area according to claim 1.

As can be gathered from the description relative to FIG. 1, the first area 17 and second area 19 are separately controllable. However, they are jointly monitored by the rod controller 13.

The radiant heater 11 is a two-circuit radiant heater. It has a diameter of 230 mm and a total rated power of 2800 W. 1100 W relate to the first area 17, 1100 W to the second area 19 and 600 W to the third area 21. Said 600 W are the so-called unprotected or uncontrolled power. FIG. 2 shows that here the temperature is approximately 50 to 60° C. lower than in the first or second area positioned centrally in the radiant heater 11. The surface power of the third area 21 is less than 2.5 W/cm$^2$, whereas the power density in the first and second areas is 7.8 W/cm$^2$.

Thus, FIG. 2 proves the fact that with heating areas having the above-described characteristics, i.e. particularly the outermost, low surface power heating area, a radiant heater can be provided with additional power, which does not have to be controlled by means of a rod controller or not by means of a single, common rod controller.

Thus, during the operation of the radiant heater the situation is such that with one-circuit operation only the first area 17 is active. In two-circuit operation the second area 19 and third area 21 are switched in an electrically separate, but time-joint manner.

Due to the fact that the power of the third area 21 does not have to be monitored by the rod controller 13 and consequently also does not have to be disconnected by the latter, the maximum switching limit thereof can be provoked by the power of the first and second areas 17 and 19.

If the control of the heating areas takes place by means of switching electronics at the connecting lugs 14, according to a further development of the invention it is possible to establish the response of the rod controller 13. As a function thereof, it would additionally be possible to disconnect the third heating area 21 in the same way, but then not directly through the rod controller 13, but instead indirectly through its function as a signal generator. However, this would not be necessary in all cases due to the thermal surface loading of the third area 21. However, this would permit a uniform operation of all the heating areas, so that with regards to the glow pattern of the radiant heater the outermost area would not continue to glow bright, whilst the central area was dark.

The invention claimed is:

1. A heating device, which is subdivided into several areas, having at least one first area and a second area and is provided with a first excess temperature protection, wherein said first area has a maximum first power and is monitored by said first excess temperature protection and said second area has a maximum surface heating power of approximately 2.5 W/cm$^2$ and is always operated without monitoring by said first excess temperature protection, wherein an electrical connection of said first area is monitored by said first excess temperature protection, wherein said first area has connecting plugs being connected to said first excess temperature protection for disconnecting said first area in the case of occurrence of an excess temperature at said first area, and wherein an electrical connection of said second area is directly to a power supply without ever interposing said first excess temperature protection for always operating completely without monitoring by excess temperature protection.

2. Heating device according to claim 1, wherein said second area engages with said first area at least along half the outer border.

3. Heating device according to claim 2, wherein said second area surrounds said first area and said areas are arranged concentrically.

4. Heating device according to claim 3, wherein said areas are circular.

5. Heating device according to claim 1, wherein said power for said first area is max 2500 Watt in the case of a circular first area with a diameter of 230 mm.

6. Heating device according to claim 1, wherein said first area has a switch-in power, which can be switched into a basic power of said first area and in a state with said switched-in power said maximum first power is applied.

7. Heating device according to claim 1, wherein said power for said second area is 600 Watt.

8. Heating device according to claim 1, wherein said excess temperature protection is a rod controller, which at least partly engages over said first area.

9. Hearing device according to claim 8, wherein there is an electronic control, which has a further relay for switching the switch-in power to said total, maximum first power, in addition to said basic power.

10. Heating device according to claim 1, wherein there is a control device with an additional contact for switching a basic power or switch-in power to said total, maximum first power for said first area.

11. Heating device according to claim 1, wherein said heating device is a radiant heater with a heating conductor made from resistance material.

12. Heating device according to claim 1, wherein said second area forms an outermost heating area.

* * * * *